US008074476B2

(12) United States Patent
Quandt

(10) Patent No.: US 8,074,476 B2
(45) Date of Patent: Dec. 13, 2011

(54) WASHER EXTRACTOR WITH IMPROVED CHEMICAL DISPENSER

(75) Inventor: Eric D. Quandt, Oshkosh, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 326 days.

(21) Appl. No.: 12/563,639

(22) Filed: Sep. 21, 2009

(65) Prior Publication Data

US 2011/0067456 A1 Mar. 24, 2011

(51) Int. Cl.
*D06F 39/02* (2006.01)

(52) U.S. Cl. ..... 68/17 R; 68/207

(58) Field of Classification Search ..... 68/12.16, 68/17 R, 207

See application file for complete search history.

(56) References Cited

U.S. PATENT DOCUMENTS

| | | | | |
|---|---|---|---|---|
| 2,482,479 | A * | 9/1949 | Hamilton | 366/342 |
| 2,664,900 | A * | 1/1954 | Fahnoe | 134/56 D |
| 3,798,932 | A * | 3/1974 | Tromblee | 68/17 R |
| 4,265,100 | A * | 5/1981 | Kretchman et al. | 68/12.18 |
| 5,017,201 | A * | 5/1991 | Park | 96/228 |
| 5,473,914 | A | 12/1995 | Pyo et al. | |
| 6,826,933 | B2 * | 12/2004 | Merkle et al. | 68/17 R |
| 7,313,934 | B2 | 1/2008 | Heo et al. | |
| 7,322,216 | B2 * | 1/2008 | Favret et al. | 68/17 R |
| 7,481,082 | B2 * | 1/2009 | Cho et al. | 68/17 R |
| 7,770,418 | B2 | 8/2010 | Kramme et al. | |
| 7,895,864 | B2 * | 3/2011 | Hill | 68/12.18 |
| 7,900,486 | B2 * | 3/2011 | Richman et al. | 68/17 R |
| 2004/0172770 | A1 | 9/2004 | Heo et al. | |
| 2005/0229652 | A1 | 10/2005 | Kim et al. | |
| 2007/0044517 | A1 * | 3/2007 | Yang et al. | 68/17 R |
| 2007/0163307 | A1 | 7/2007 | Kramme et al. | |
| 2007/0240456 | A1 * | 10/2007 | Byun et al. | 68/17 R |
| 2008/0295546 | A1 * | 12/2008 | Cho et al. | 68/17 R |
| 2010/0095712 | A1 * | 4/2010 | Kim | 68/12.18 |

FOREIGN PATENT DOCUMENTS

| | | |
|---|---|---|
| DE | 37 10 840 | * 10/1987 |
| DE | 37 12 323 | * 10/1988 |
| FR | 2 591 245 | * 6/1987 |
| GB | 2 136 831 | * 9/1984 |
| GB | 1 187 764 | * 9/1987 |
| JP | 04-352918 | * 12/1992 |
| JP | 05-309194 | * 11/1993 |
| JP | 2004-008277 | * 2/2004 |
| JP | 2006-255300 | * 9/2006 |

OTHER PUBLICATIONS

European Patent Office 1 703 012 Sep. 2006.*

* cited by examiner

*Primary Examiner* — Frankie L Stinson
(74) *Attorney, Agent, or Firm* — Leydig, Voit & Mayer, Ltd.

(57) ABSTRACT

A clothes washing machine having a dispenser for directing chemical additives, such as fabric softener, bleach, or the like, into the wash water during a washing operation. The dispenser includes a siphoning device having a water inlet, an upstanding siphoning tube, and a chemical additive receptacle about the siphoning tube. Upon the direction of water into the siphon cup from the inlet, water is directed both downwardly into the siphon cup for raising the liquid level above the top of the siphoning tube while simultaneously being directed through a plurality of relatively small substantially horizontal passageways that impart a plurality of pressurized liquid flow streams or sprays across an upper portion of the liquid within the siphon cup for further intermixing the water and chemical additive and for preventing the buildup of chemical additives on side walls of the siphon cup.

17 Claims, 4 Drawing Sheets

WASHER EXTRACTOR WITH IMPROVED CHEMICAL DISPENSER

FIELD OF THE INVENTION

The present invention relates generally to clothes washer/extractors, and more particularly, to an improved chemical dispensing system for supplying chemical additives, such as fabric softeners, bleaches, and the like, into the wash water of a washer/extractor during a washing cycle.

BACKGROUND OF THE INVENTION

Clothes washer/extractors commonly are used in commercial and public establishments, such as coin-operated laundries, which have a compartmentalized dispenser into which detergents and chemical additives are added by a user prior to a wash cycle. Such dispensers typically comprise open top compartments, such as two compartments for filling with detergent to be used during pre-wash and wash cycles and two compartments for chemical additives, such as fabric softener and/or bleach, that the user wishes to add to the wash water during wash and/or rinse cycles.

For mixing water with the chemical additives, such as a fabric softener, prior to dispensing into the wash water, it is known for the chemical additive chamber to include a cup shaped siphoning device into which the liquid chemical additive is deposited. Water supplied to the chemical additive chamber during a wash cycle enters the bottom of the siphoning device, causing the fabric softener or bleach additive to mix and rise upwardly to the top of a siphoning tube. Once a sufficient liquid level is reached, water mixed with the chemical additive both over flows the siphon cup and also flows into and through the siphoning tube for direction into the wash tub of the washing machine. After the water supply to the chemical additive chamber is automatically turned off, siphoning of the liquid through the siphoning tube continues until the siphon cup is empty.

A problem with such siphon operated dispensers is that a residue of the chemical additive is left within the siphon cup. After a number of wash cycles, this can create a significant buildup which can impede proper operation of the dispenser and contaminate the chemical additive the next user may wish to use in a wash cycle. The residue buildup further creates an unclean and unsightly appearance, particularly undesirable in public establishments, that can accumulate mold over time.

OBJECTS AND SUMMARY OF THE INVENTION

It is an object of the present invention to provide a washer/extractor having an improved siphon operated chemical additive dispenser.

Another object is to provide a washer/extractor having a siphon operated chemical dispenser that is operable for automatically directing chemical additives, such as fabric softeners and bleaches into the wash water, without leaving an undesirable residue or buildup of the additive in the siphon cup.

A further object is to provide a washer/extractor as characterized above in which the chemical additive dispenser more effectively mixes water with the chemical additive prior to direction into the washing machine.

Yet another object is to provide a washer/extractor having a chemical additive dispenser of the foregoing type which is relatively simple in construction and operation and lends itself to economical manufacture.

Other objects and advantages of the invention will become apparent upon reading the following detailed description and upon reference to the drawings, in which:

Figure 1:
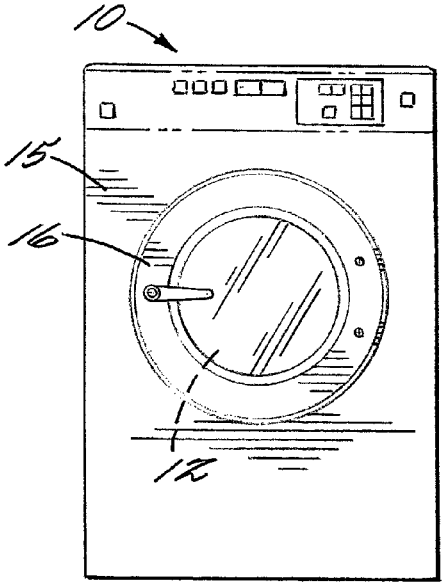
FIG. 1 is a front plan view of an illustrative washer/extractor having a chemical additive dispensing system in accordance with the invention.
Figure 2:
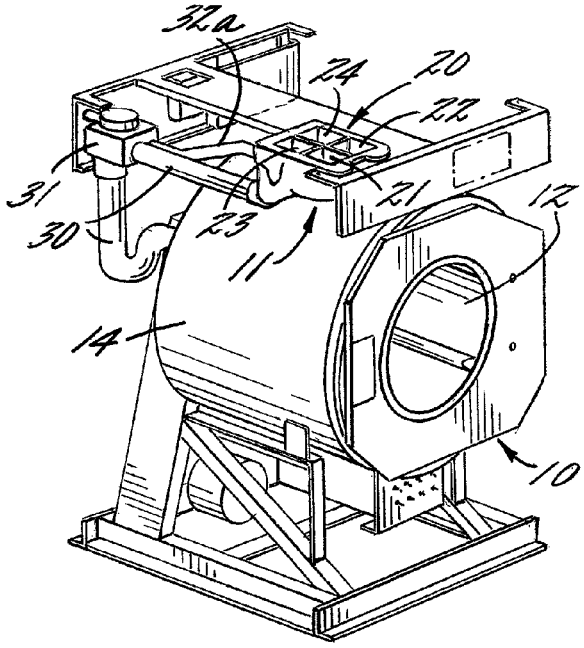
FIG. 2 is a perspective of the washer/extractor shown in FIG. 1 with the motor housing panels removed.
Figure 3:
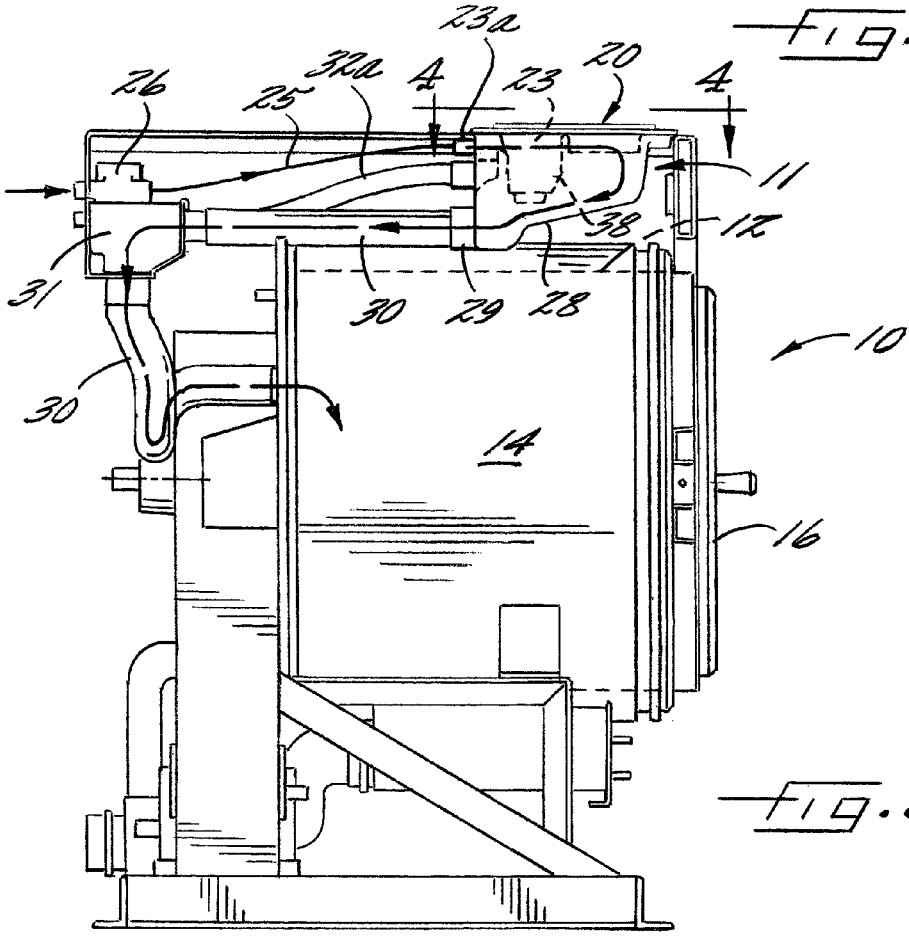
FIG. 3 is an enlarged side elevational view of the washer/extractor shown in FIG. 2.
Figure 4:
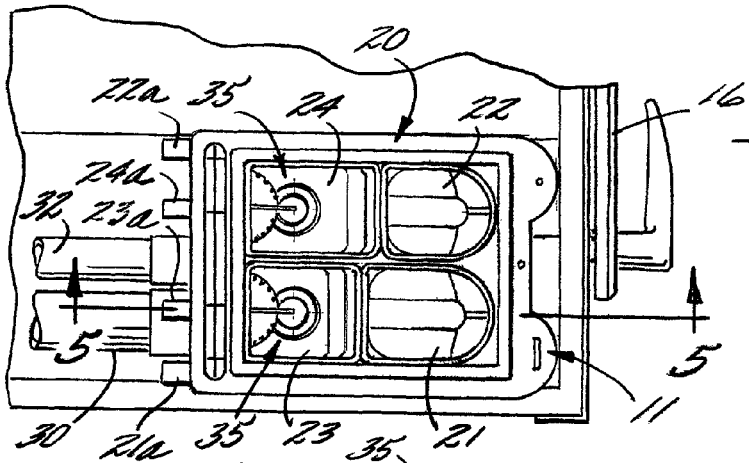
FIG. 4 is an enlarged top view of the chemical additive dispenser, taken in the plane of line-4-4 in FIG. 3.
Figure 5:
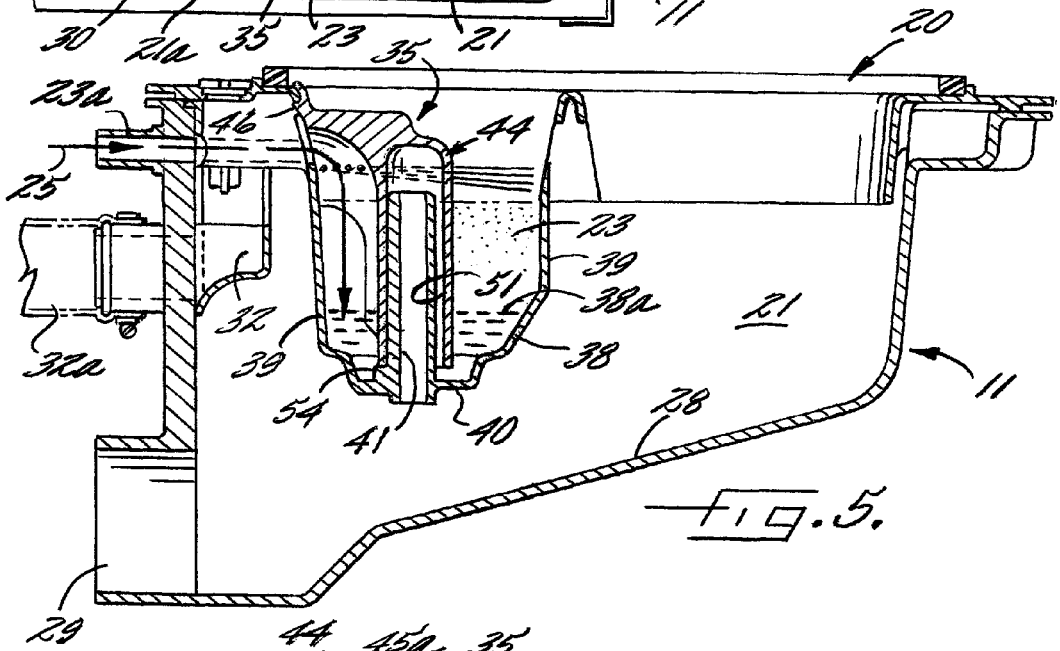
FIG. 5 is an enlarged fragmentary section of the illustrative chemical dispenser system taken in the plane of line 5-5 in FIG. 4.
Figure 6:
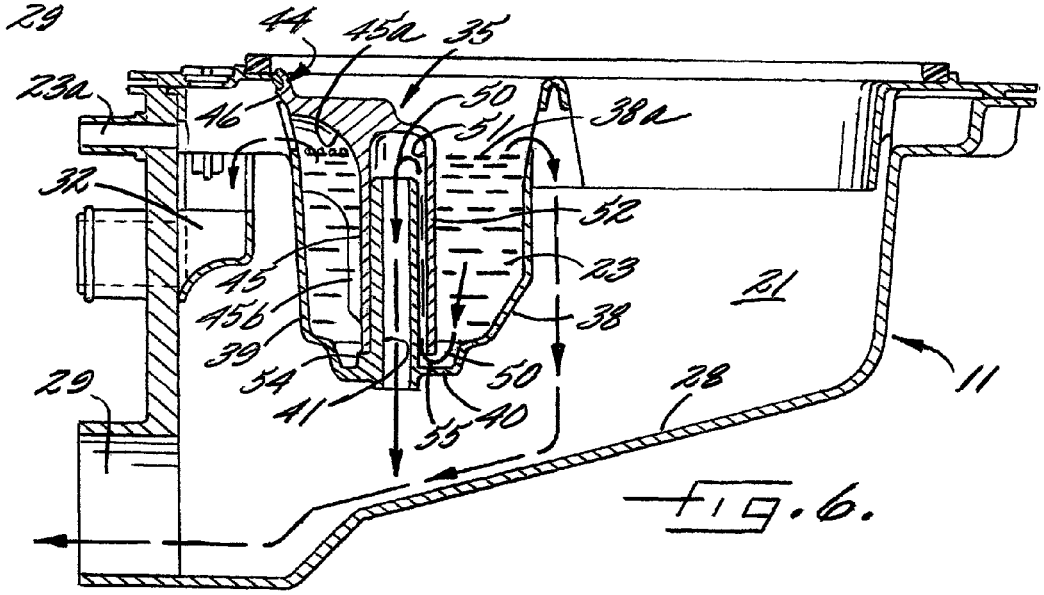
FIG. 6 is an enlarged fragmentary section of the illustrative chemical dispenser system similar to FIG. 5 with water mixed with chemicals over flowing the dispenser and down a siphon tube.
Figure 7:
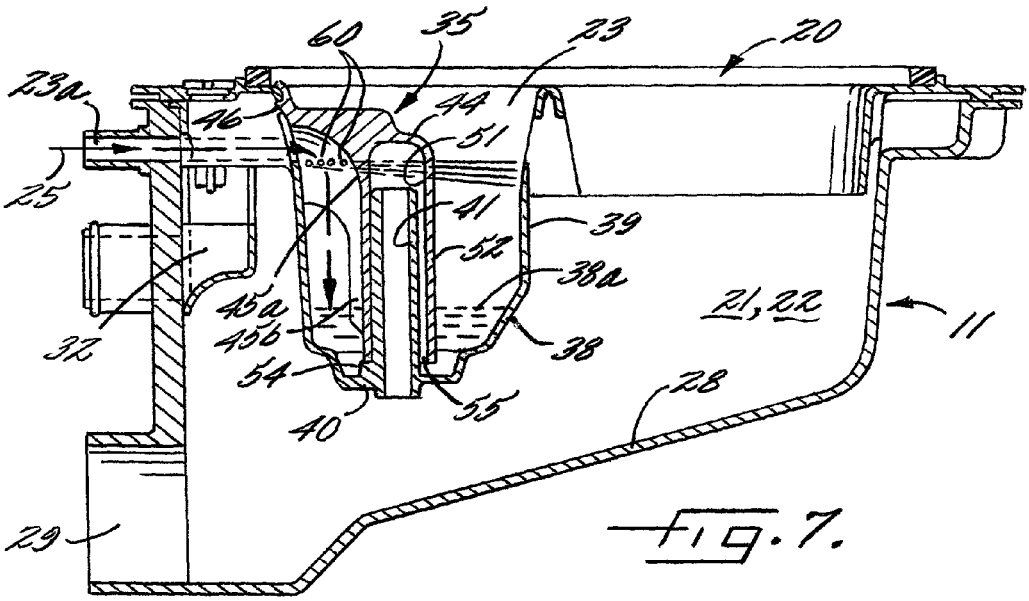
FIG. 7 is a further fragmentary section of the chemical dispenser, similar to FIGS. 5-6.
Figure 8:
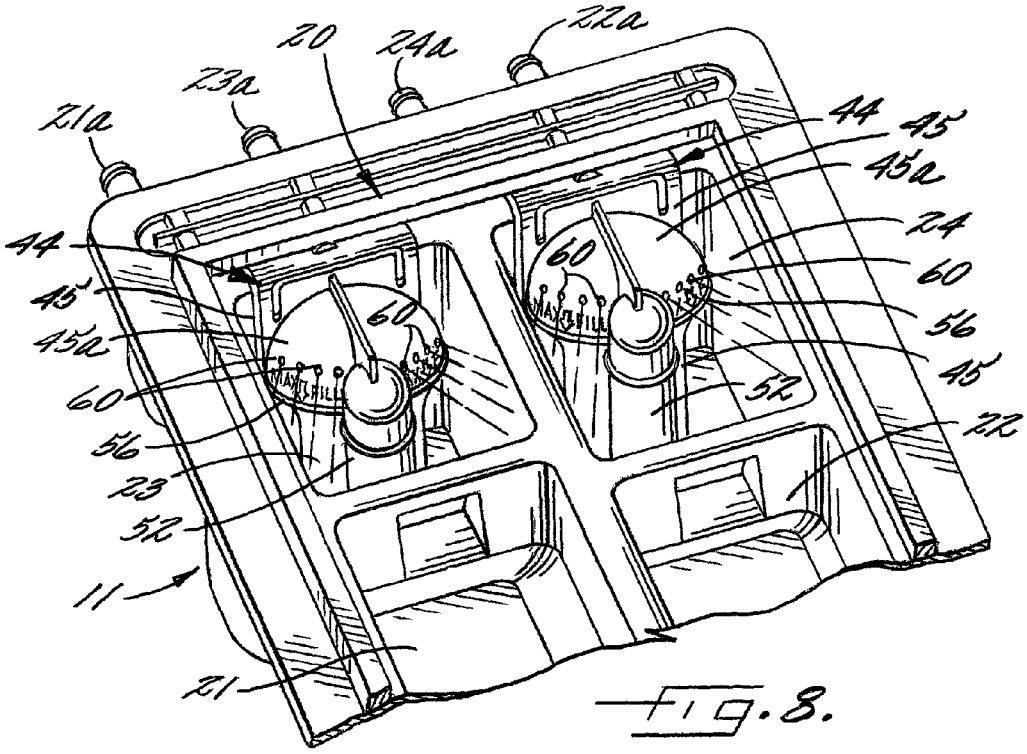
FIG. 8 is a top perspective of the chemical additive dispenser.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative washer/extractor 10 for washing clothes and the like having a detergent and chemical additive dispensing system 11 in accordance with the invention. It will be understood that the washer/extractor 10 may be a washing machine of the type referred to in the trade as a cabinet hard mount washer/extractor, which is commonly used in coin-operated laundries. The illustrated washing machine 10 has a front opening power driven cylindrical basket 12 into which clothes or other items to be washed are introduced rotatably-disposed and within a wash tub 14. The washing machine 10 has an outer panel formed housing 15 with a front opening door 16 for providing the washer/extractor with a clean appearance, which is desirable for clothes washing machines used in public establishments, such as coin-operated laundries.

For filling the washing tub 14 with wash water and simultaneously directing detergent and chemical additives into the wash water, a multi-functional dispenser 20 is mounted in a top panel of the washing machine 10 adjacent a front side thereof for easy access. The dispenser 20 in this case comprises four open top dispensing chambers 21, 22, 23, 24 each having a respective water inlet 21*a*, 22*a*, 23*a*, 24*a*, coupled to a respective hose 25 controlled in a conventional manner by a respective automatically operable valve 26 located adjacent a rear side of the washing machine. The front two chambers 21,22 in this case are designed to be filled with detergent by a user prior to the wash cycle. The rear chambers 23,24 are designed for receiving chemical additives, such as fabric softeners, bleach, or the like, as may be desired by the user during a wash cycle. As is known in the art, hot water may be selectively directed into the chambers 21,22 for dispensing detergent to the wash water during prewash and wash cycles and water may be selectively directed to the chambers 23,24 for automatically directing fabric softener and bleach, respectively, into the wash water during the main wash or final rinse cycles.

Each of the top opening chambers 21-22 has a downwardly and rearwardly tapered bottom wall 28 that communicates with a respective main outlet opening 29 of the chamber, which in turn is connected to an outlet hose 30 that communicates with the wash tub 14 through a vacuum breaker 31 in a conventional manner. Each chamber 21-22 also has an overflow discharge opening 32 above the main outlet opening 29 also connected by an outlet hose 32*a* and communicating with the wash tub 14.

For mixing a chemical additive with the wash water prior to direction to the wash tub 14, each chemical additive chamber 23,24 has a siphoning device 35 mounted in the respective chamber 23,24. Since the siphoning devices 35 are similar in construction and operation, only one need be described in detail. For purposes herein, the chemical additive chamber 23 is described for adding a fabric softener to the wash water. The illustrated siphoning device 35 includes an open top siphon cup 38 supported within the dispensing chamber 22 on a rear side thereof. The siphon cup 38 has side walls 39, a bottom wall 40, and an upwardly extending siphoning tube 41 supported by and communicating through the bottom wall 40.

For directing water from the water inlet 23*a* downwardly into the siphon cup 38, a cover 44 is supported in overlying relation to the upstanding siphoning tube 41. The cover 44, which in this instance is a separate plastic injection molded part, has a rear side wall 45 with a clip 46 adapted for snap action engagement with the upper rear side wall 39 of the siphon cup 38. For directing water from the water inlet 23*a* downwardly into the siphon cup 38, the cover side wall 45 has a rearwardly facing upper spherically configured concave dome portion 45*a* opposite the water inlet 23*a* and a concave channel portion 45*b* extending downwardly from the dome portion 45*a*.

For defining an annular siphoning flow passageway 50 about the upstanding siphoning tube 41, the cover 44 is formed with a closed top, downwardly opening cylindrical chamber 51 that is positionable over the siphoning tube 41 as an incident to mounting of the cover 44 within the siphon cup 38. The cylindrical chamber 51 in this case is defined by an integrally formed cylindrical projection 52 of the cover that extends downwardly a distance below the cover side wall 45. The cover 44 is supported in the chamber 23 with the bottom end of the cylindrical projection 52, and hence the bottom end cylindrical chamber 51, supported by a plurality of small circumferentially standoffs 54 for defining a flow passageway 55 between the underside of the cylindrical projection 52 and chamber 51 to the annular siphoning flow passageway 50 between the siphoning tube 41 and the interior wall of the cylindrical chamber 51 to the upper open end of the siphoning tube 41.

Prior to the washing operation, a liquid chemical additive, such as fabric softener, is poured into the siphon cup 38 up to a level slightly below the upper end of the siphoning tube 41. For convenient reference, the illustrated cover 44 is formed with a horizontal fill line 56 in the form of an outwardly extending horizontally bead and an adjacent indicia "MAX FILL". (See FIG. 10)

As will be understood by a person skilled in the art, during a wash cycle, the hot water control valve 26 for the liquid supply line 25 to the fabric softener dispenser 23 may be actuated to direct water to the inlet 23*a* of the dispenser cavity 23 and siphon cup 38. The incoming stream of water is directed downwardly by the cover side wall dome and concave portions 45*a*,45*b* to the bottom of the siphon cup 38, mixing with the previously added fabric softener while raising the liquid level 38*a* within the cup. Once the liquid level raises above the top of the siphoning tube 41, water mixed with softener both overflows the cup 38 and enters the top of the siphoning tube 41 for direction into the bottom of the dispensing chamber 21 and through the outlet 29 for direction to the wash tub 14.

In accordance with an important aspect of invention, the siphoning device has a plurality of water discharge orifices in close proximity to and in communication with the water inlet to the dispenser chamber and siphon cup for directing a plurality of pressurized liquid flow streams across a top of liquid in the siphon cup for facilitating intermixing of the water with the fabric softener or other chemical additive and for impinging against the opposed side of the cup for preventing a residue buildup. To this end, in the illustrated embodiment, the cover concave domed portion 45*a* is formed with a plurality of small liquid flow discharge orifices 60 radially directed in substantially horizontal fashion at a location above the liquid fill line 56, and in this instance slightly above the top of the siphoning tube 41, and in substantial alignment with the water inlet 23*a* to the siphon cup 38. Hence, as water is directed through the inlet 23*a*, it is simultaneously directed downwardly into the cup 38 by the cover dome and concave portions, 45*a*,45*b*, and through the plurality of discharge orifices 60 in a form of individual pressurized liquid flow streams or sprays across a top portion of the liquid within the siphon cup. The discharge orifices 60 thereby enable direct spraying or the pressurized direction of a plurality of flow streams into contact with liquid in the upper portion of the siphon cup 38, while liquid is simultaneously being indirectly mixed from the bottom of the cup 38 by the downwardly directed liquid from the dome and concave portions 45*a*,45*b* of the cover. The pressurized liquid flow streams both facilitate intermixing of water and the liquid in the upper portion of the siphon cup 38 and impinge upon the side of the siphon cup 38 opposite the discharge orifices 60 for cleansing the siphon cup and preventing the undesirable buildup of chemicals along the wall of the siphon cup, as heretofore has been a problem.

Figure 9:
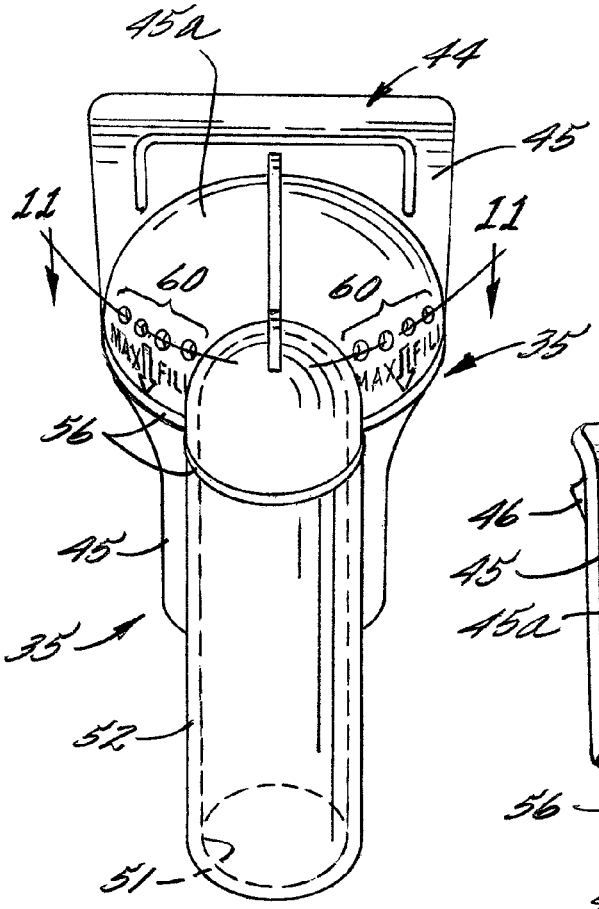
FIG. 9 is a perspective of the cover of the dispenser shown in FIG. 8.
Figure 10:
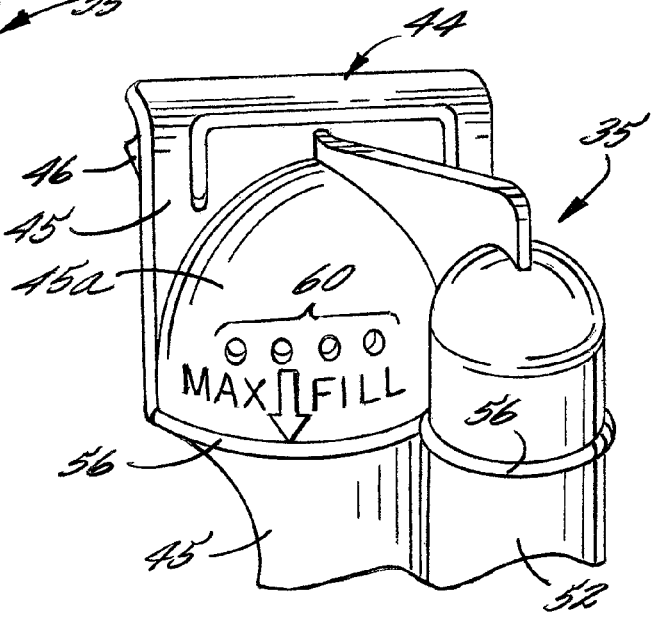
FIG. 10 is an enlarged perspective of an upper portion of the cover shown in FIG. 9.
Figure 11:
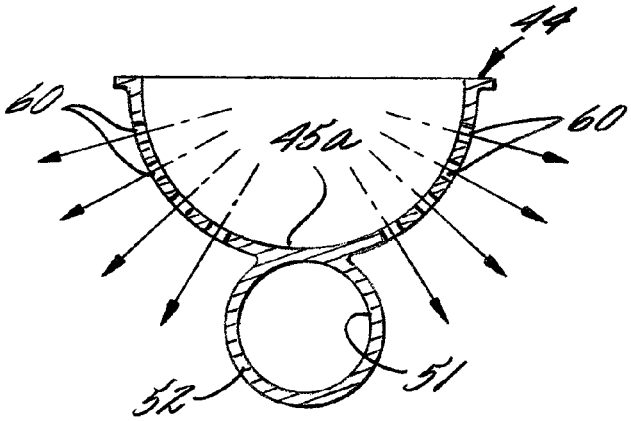
FIG. 11 is a horizontal section of the illustrated dispenser cover taken in the plane of line 11-11 of FIG. 9.

In the illustrated embodiment, a plurality of discharge orifices 60 are located on each side of the cylindrical projection 52 of the siphon cup 38. In the illustrated embodiment, as seen in FIGS. 9-11, four discharge orifices 60 are formed on each side of the cylindrical projection 52 for directing pressurized flow streams substantially throughout the upper portion of the liquid as it rises above the top of the siphoning tube 41. The discharge orifices 60 preferably are sized such that less than half, and most preferably between 20-25% of the water, directed from the inlet 23*a* is introduced into the siphon cup through the discharge orifices 60, while the remaining water is directed downwardly by the cover 44 for indirect mixing of the chemical additive in the siphon cup. In practice, pressurized flow stream discharge orifices of between 1/16 and 1/8$^{th}$ inch diameter have been found to provide optimum intermixing of water with the chemical additive and the forceful impingement of the flow streams against the opposite side of the siphon cup 38 for maintaining the cup in a relatively clean condition free of undesired buildup.

From the foregoing, it can be seen that a siphon operated chemical dispenser for the washer extractor is provided that both enhances intermixing of water with the chemical additive and prevents undesirable buildup of the additive in the siphon cup that can contaminate subsequent usage of the washing machine and/or frequent costly maintenance. Yet, the chemical additive dispenser remains relatively simple in construction and operation and lends itself to economical manufacturer.

The invention claimed is:

1. A washing machine comprising:

a wash tub for receiving wash water during a washing operation, a rotatably driven cylindrical basket for receiving launderable items for washing supported within said wash tub, a dispenser including a chemical additive chamber having a water inlet for connection to a water supply line and an outlet connected to and communicating with the wash tub, a siphoning device including a siphon cup supported within said chemical additive chamber having a bottom wall, an upstanding siphoning tube supported by and communicating through said bottom wall, and side walls for defining a chemical additive receptacle about said siphoning tube for receiving a predetermined quantity of a chemical additive up to a level below the top of said siphoning tube prior to a wash cycle, said siphon cup having a water inlet in communication with said water inlet, a cover formed with a closed top downwardly opening cylindrical chamber supported in overlying relation to said siphoning tube for defining a siphoning passageway communicating with said receptacle about an underside of said cylindrical chamber, upwardly along an annular passageway between said siphoning tube and cylindrical chamber, and into a top of said siphoning tube such that with siphon cup filled with a predetermined quantity of the chemical additive and the introduction of water into said receptacle from said water inlet the liquid level in said siphon cup will rise above the level of said siphoning tube for causing the simultaneous overflow of liquid from the siphon cup into said chemical additive chamber and the flow of liquid into and through the siphoning tube for simultaneous discharge from said chemical additive chamber outlet to said wash tub, and said siphoning device being formed with a plurality of liquid discharge orifices in communication with said water inlet for directing a plurality of pressurized liquid flow streams across an upper portion of liquid within said siphon cup for further intermixing the water and chemical additive for preventing buildup of the chemical additive on the side wall of the siphon cup.

2. The washing machine of claim 1 in which said discharge orifices are located at an elevation above the top of said siphoning tube.

3. The washing machine of claim 1 in which said discharge orifices direct said pressurized liquid flow streams in a substantially horizontal direction across an upper portion of liquid within said siphon cup.

4. The washing machine of claim 3 in which said cover is formed with a side wall for directing water from said water inlet downwardly into a bottom of said suction cup, and said discharge orifices are formed in said side wall in aligned relation to said water inlet for simultaneously directing plurality of pressurized liquid flow streams across an upper portion of liquid in said suction cup.

5. The washing machine of claim 4 in which said side wall is formed with a concave dome portion in aligned relation to said water inlet and a downwardly extending concave portion extending downwardly from said dome portion, and said discharge orifices are formed in said dome portion.

6. The washing machine of claim 5 in which said dome portion has a spherical configuration, and said discharge orifices extend radially through said dome portion.

7. The washing machine of claim 1 in which said discharge orifices are formed in said cover.

8. The washing machine of claim 1 in which said cover is formed with a fill line indicating the level of said predetermined quantity of chemical additive in said siphon cup, and said discharge orifices are located at an elevation above said fill line.

9. The washing machine of claim 1 including at least six said liquid discharge orifices.

10. The washing machine of claim 1 including at least eight said liquid discharge orifices.

11. The washing machine of claim 1 in which said cylindrical chamber is defined by a cylindrical extension of said cap, and a plurality of said discharge orifices extend through said cap on one side of said cylindrical extension and a plurality of said discharge orifices extend through said cap on an opposite side of said cylindrical extension.

12. The washing machine of claim 1 in which said discharge orifices are sized such that less than half of the water directed from said water inlet passes through said discharge orifices.

13. The washing machine of claim 1 in which said discharge orifices are sized such that between about 20% and 25% of the water directed from said water inlet is directed through said discharge orifices and the remaining water is directed downwardly into said suction cup.

14. The washing machine of claim 13 in which said discharge orifices are between about 1/16" and 1/8" inch in diameter.

15. The washing machine of claim 1 in which said cover is a part separated from said siphon cup.

16. The washing machine of claim 1 in which said dispenser includes a plurality of said chemical additive chambers each having a respective water inlet and siphoning device.

17. The washing machine of claim 1 in which said dispenser includes a plurality of detergent receiving chambers each connected to a respective water inlet for mixing detergent with water and directing the water to the wash tub.

* * * * *